United States Patent [19]

Ratz

[11] 4,206,006

[45] Jun. 3, 1980

[54] HYBRID ROCKET PROPELLANT WITH NITROSO DERIVATIVE OF HEXAMETHYLENE TETRAMINE

[75] Inventor: Heinz Ratz, Troisdorf, Fed. Rep. of Germany

[73] Assignee: Dynamit Nobel Aktiengesellschaft, Fed. Rep. of Germany

[21] Appl. No.: 491,502

[22] Filed: Sep. 17, 1965

[30] Foreign Application Priority Data

Sep. 18, 1964 [DE] Fed. Rep. of Germany ..... 45447

[51] Int. Cl.[2] ..... C06B 45/10

[52] U.S. Cl. ..... 149/19.9; 60/219; 149/19.92; 149/92

[58] Field of Search ..... 149/19, 92, 19.9, 19.92; 60/219

[56] References Cited

U.S. PATENT DOCUMENTS

| | | | |
|---|---|---|---|
| 1,720,459 | 7/1929 | Wyler | 149/46 |
| 2,997,376 | 8/1961 | Bartley | 149/19 |
| 3,066,139 | 11/1962 | Zhivadinovich et al. | 149/61 |
| 3,083,526 | 4/1963 | Hudson | 149/19 |
| 3,177,101 | 4/1965 | Vriesen | 149/19 |

*Primary Examiner*—Edward A. Miller

*Attorney, Agent, or Firm*—Craig and Antonelli

[57] ABSTRACT

A rocket fuel is formed by mixing a liquid prepolymer of butadiene having carboxyl groups with hexamethylene tetramine or a nitroso derivative thereof, shaping and hardening.

6 Claims, No Drawings

HYBRID ROCKET PROPELLANT WITH NITROSO DERIVATIVE OF HEXAMETHYLENE TETRAMINE

The invention relates to rocket fuels of the hybrid type and to a method of making such fuels.

Heretofore, for the propulsion of rockets, both solid fuel systems and fluid fuel systems have been used, as well as solid-fluid systems. The latter are designated as hybrids, and have as an oxidizing medium nitric acid, dinitrogen tetroxide, tetranitromethane, or mixtures thereof, or hydrogen peroxide.

As fuels almost any energy-rich organic compound can theoretically be used; however, because of the requirements of workability, suitable mechanical characteristics and the ignition and burning characteristics, the field of practical fuels is rather narrow. In general, it has been limited to synthetic resins, and the systems heretofore known use principally polymeric hydrocarbons, polymethacrylates, polyesters, epoxide polymers and the like.

Next to the mechanical characteristics and formability, the energy content of the system is important. In this respect, polymeric hydrocarbons, such as polyethylene, polypropylene, polybutylene, polybutadiene and similarly formed compounds would be preferred, if it were not relatively difficult to react these compounds with oxygen. A further very important consideration is the reactivity of the components—the oxidation medium and the synthetic resin fuel—with each other. But in this respect, the polymeric hydrocarbons are slow-reacting compounds, so that their use presents substantial difficulties unless special precautions are taken. Both the speed of ignition and the regression speed are very slow; besides which, a vigorous preheating of the oxidation medium is necessary in order to give a predictable ignition and burning away.

If hydrogen peroxide is used as the oxidation medium, catalytic decomposition of the peroxide results in a sufficiently high temperature of the steam-oxygen mixture to initiate and maintain the reaction. However, the results are less satisfactory when using highly concentrated nitric acid, nitrogen tetroxide ($N_2O_4$) and tetranitromethane. The compounds do not decompose sufficiently exothermically, and the decomposition cannot be controlled in the same way as that of hydrogen peroxide. If a uniform and safe ignition and burning are to be achieved, a precombustion step is needed, for example, by injecting a material which reacts hypergolically with the nitric acid or with the usual oxidation medium and nitric acid, that is, igniting instantly on contact, or by introducing hot combustion gases, and possibly a simultaneously igniting solid propellant charge.

A simpler way is the incorporation of substances in the solid fuel which increase the reaction speed with respect to the oxidation medium, and possibly react hypergolically, and, so to speak, to expose the reaction-maintaining material for the oxidation.

Such materials have been found in hexamethylenetetramine, as well as in nitrited products thereof, such as dinitrosopentamethylenetetramine and trinitrosotrimethylenediamine. By using these substances in a proportion of about 5% to 50%, based on the total mass of the fuel, either alone or in admixture, it is possible to vary within wide limits the speed of reaction with the oxidizer.

These compounds are only moderately heat resistant, that is, able to withstand the temperatures used in the normal forming of thermoplastic hydrocarbon polymers without decomposition. It is therefore desirable to reduce the working temperature by the addition of plasticizers, although the resulting charges have a relatively smaller heat stability (Example 1).

It is therefore desirable to find a way to obtain, along with lower working temperatures, adequate mechanical properties, especially heat stability, and to impart a high reactivity to the fuel with highly concentrated nitric acid and its mixtures with other oxidizing media. It has been found that most favorable results in these respects can be achieved by the process of the invention.

According to the invention, there is used a prepolymer with a molecular weight of about 3000 to 5000, such as the known polybutadiene with terminal carboxyl groups U.S. Pat. No. 3,108,994) or mixed polymer of butadiene with acrylic or methacrylic acid with about 1% to 3% carboxyl groups, which are more or less viscous liquids. Into these prepolymers are introduced the ignition catalysts according to the invention in the desired proportion without decomposition. The proportion of added material depends on the castability or workability, the desired mechanical behavior and the burning characteristics. The prepolymers can be used alone or with the addition of paraffins, unsaturated long-chain hydrocarbons or prepolymeric polybutadiene.

The hardening of the prepolymers is produced in a conventional manner by trifunctional cross-linking agents, such as, for example, the corresponding epoxydes or alkylenimides.

These mixtures can also contain substantial quantities of solid polymeric hydrocarbons, such as polyethylene, polypropylene, polybutylene, polybutadiene or the like, in the form of fine or granular particles, by which the energy content is increased, and, with small quantities of reaction accelerators, sedimentation is avoided.

The fuels according to the invention are especially suitable in connection with highly concentrated nitric acid and nitric acid containing liquid oxidation media. The heat of combustion of these systems lies between about 7,500 and 10,000 calories.

The following are examples of the production of rocket fuels according to the invention.

EXAMPLE 1

There is added to polyisobutylene such a quantity of a fluid long-chain hydrocarbon, such as prepolymeric liquid polybutene, that it can be worked at below 100° C. There are added to this material in a mill 20% trinitrosomethylenetriamine based on the total mass. The material is homogenized and worked at 80° to 90° C. in a known way and is finally shaped by an extruding screw to a shaped strand. The resistance of this material to cold is good, but the heat resistance is lower than in the remaining examples. The heat of combustion is about 9500 calories, the reactivity of the fuel as compared to a mixture without the reaction accelerator is greatly improved.

EXAMPLE 2

500 grams of a liquid prepolymer of butadiene with terminal carboxyl groups and a molecular weight of 4500 are intimately mixed with 500 grams of hexamethylenetetramine. Finally, there is added 25 grams of phosphoric acid tripropyleneimide, and the material is mixed for 10 more minutes and cast in the desired shape. After 24 hours hardening at 110° C., it is allowed to cool. There results a body of adequate mechanical properties with good heat resistance and very good cold resistance. The heat of combustion is 7600 calories. The body reacts even under normal pressure instantaneously with highly concentrated nitric acid with strong foaming of the surface.

EXAMPLE 3

500 grams of a liquid mixed polymer of butadiene and methacrylic acid with 2% carboxyl groups and a molecular weight of 3500 are intimately admixed in a mixer with 200 grams of granular polymethylene. Finally, 80 grams of dinitrosopentamethylenetetramine and 40 grams of phosphoric acid trimethylenimide as a hardener are added. The material is then cast in the desired shape. Hardening takes place at 80° C. for 40 hours. The heat of combustion is 9500 calories. On contact with highly concentrated nitric acid, under normal pressure, spontaneous explosion and strong foaming on the surface are produced.

While I have described herein some embodiments of my invention, I wish it to be understood that I do not intend to limit myself thereby except within the scope of the claims hereto or hereinafter appended.

I claim:

1. Process for the production of a hybrid fuel for rocket propulsion, comprising adding to a base fuel, consisting essentially of a liquid prepolymer of butadiene with terminal carboxyl groups and a trifunctional cross-linking agent, a nitroso derivative of hexamethylenetetramine in a quantity of 5% to 50% of the total mass, and shaping the resulting product.

2. Process as claimed in claim 1, in which said base fuel further contains a liquid hydrocarbon.

3. Process as claimed in claim 1, in which said base fuel further contains a solid hydrocarbon.

4. A hybrid rocket fuel substance in the form of a shaped mass of a material comprising a base fuel consisting essentially of a liquid prepolymer of butadiene with terminal carboxyl groups and a nitroso derivative of hexamethylene tetramine in a quantity of 5% to 50% of the total mass hardened by a trifunctional cross-linking agent.

5. A rocket fuel as claimed in claim 4 in which the cross-linking agent is an alkylenimid.

6. A rocket fuel as claimed in claim 4, in which the cross-linking agent is selected from phosphoric acid tripropylenimide and phosphoric acid triethylenimide.

* * * * *